US005372714A

United States Patent [19]

Logue, Jr.

[11] Patent Number: 5,372,714

[45] Date of Patent: Dec. 13, 1994

[54] STORM SEWER CATCH BASIN AND FILTER

[76] Inventor: George E. Logue, Jr., HC 64, Box 298 A, Trout Run, Pa. 17771

[21] Appl. No.: 139,098

[22] Filed: Oct. 21, 1993

[51] Int. Cl.[5] ..... E03F 5/14

[52] U.S. Cl. ..... 210/164; 210/163; 210/232; 210/237; 210/445; 210/474; 404/4; 404/5

[58] Field of Search ..... 404/2, 3, 4, 5; 210/162, 163, 164, 165, 232, 445, 473, 474, 237

[56] References Cited

U.S. PATENT DOCUMENTS

| | | | |
|---|---|---|---|
| 806,920 | 12/1905 | Rossi | 210/474 |
| 809,201 | 1/1906 | Lutz | 210/237 |
| 1,310,055 | 7/1919 | Caldwell | 210/164 |
| 1,654,247 | 12/1927 | Egan | 210/164 |
| 1,746,121 | 2/1930 | Levy | 210/237 |
| 2,102,310 | 12/1937 | Egan | 210/237 |
| 2,246,012 | 6/1941 | Sanders | 210/163 |
| 2,263,259 | 11/1941 | Boosey | 210/164 |
| 2,615,526 | 10/1952 | Lane | 210/164 |
| 3,282,430 | 11/1966 | Kinne | 210/162 |
| 3,713,539 | 1/1973 | Thompson et al. | 210/164 |
| 4,388,191 | 6/1983 | Morgan | 210/452 |
| 4,419,232 | 12/1983 | Arntyr et al. | 210/164 |
| 5,032,264 | 7/1991 | Geiger | 210/163 |
| 5,066,165 | 11/1991 | Wofford et al. | 405/119 |
| 5,133,619 | 7/1992 | Murfae et al. | 404/4 |
| 5,197,236 | 3/1993 | Calhoun et al. | 52/4 |

OTHER PUBLICATIONS

Atlantic Construction Fabrics, Inc. (ACF) Brochure "Complete Source For Geosynthetics".

*Primary Examiner*—Peter A. Hruskoci
*Assistant Examiner*—Robert J. Popovics
*Attorney, Agent, or Firm*—Thomas Hooker

[57] ABSTRACT

The invention relates to a removable filter for buried catch basins. The filter includes a bag located below grade level in the catch basin and looped flaps which extend above grade level and aid in removal of the filter from the catch basin. The filter is held in place in the basin by a heavy grate which rests on the flaps. The flaps extend at grade level away from the grate. The filter is removed from the catch basin for dumping by inserting a lift rod in each flap loop and hooking lift chains to the rods at openings in the loops.

15 Claims, 2 Drawing Sheets

STORM SEWER CATCH BASIN AND FILTER

FIELD OF THE INVENTION

The invention relates to filters for storm sewer catch basins.

DESCRIPTION OF THE PRIOR ART

Ground water from heavy rains or melted snow is collected in a storm sewer catch basin and flows into an underground sewer line. The water flows into the basin through openings in a grate on the top of the basin.

Water entering a sewer line should be free of solids. Conventional storm sewer filters remove solids from the water before the water flows into the catch basin. These filters are made of a porous material and are located at or above grade level. The filters may be placed horizontally on the top of the grate or may be stood up vertically in a circle above grade level, surrounding the grate. Water flows freely through the filter and into the catch basin. Solids are captured by the filter. Over time, the solids build up on the filter, impede the free flow of water through the filter and the collected water floods the area surrounding the storm sewer. Conventional ground storm sewer filters located at or above grade level are readily visible.

For the foregoing reasons there is need for a below grade catch basin filter which filters solids from water without impeding the flow of water through the catch basin and into the sewer and which is easily removed from the catch basin for dumping when filled.

SUMMARY OF THE INVENTION

The invention is a storm sewer catch basin and a removable storm sewer filter. The filter is held in a storm sewer catch basin below grade level between the top of the basin and a grate. The filter includes a bag formed from a porous geotextile material having inwardly tapered sidewalls and flaps at the top of the bag. The grate rests on the flaps to hold the bag in place in the basin. The ends of the flaps are looped and extend at grade level away from the grate. Openings are spaced along the length of the edges of the looped flaps.

Water and solids flow through the openings in the grate and into the catch basin. The water flows into and through the filter bag and out the catch basin. Solids are captured in the bag. The solids accumulate in the bag below grade level and out of sight without impeding the flow of water through the catch basin. When it is necessary to remove the full bag from the catch basin, rods are inserted into the looped flaps, the grate is removed and hooks are secured to the exposed rods at the openings to permit lifting of the heavy, filled filter. The filter is dumped and replaced in the basin, the rods are removed and the grate is refitted in the top of the basin to hold the filter in place.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
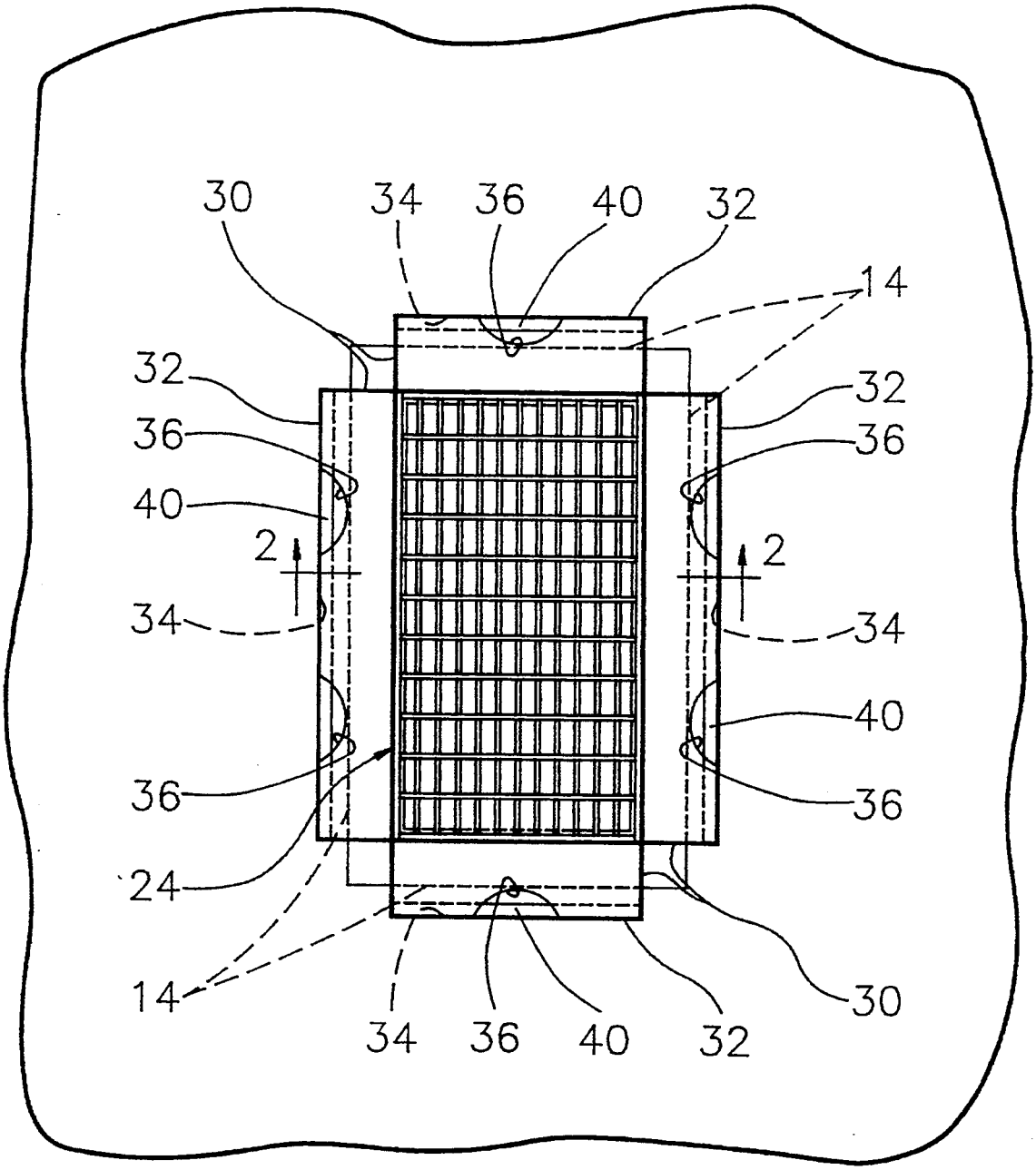
FIG. 1 is a top view of a filter bag in a catch basin below a grate with filter bag flaps extending away from each side of the basin.

Concrete catch basin 12 has an open upper end located at grade level, in-ground sidewalls 14 and floor 16. Concrete storm sewer pipe 18 extends away from one of the sidewalls 14 a distance above floor 16. The sidewalls and floor define chamber 20. A recess or groove 22 extends around the inner edge of the top of the catch basin facing chamber 20. Rectangular grate 24 closes the top of basin 12. The sides of the grate fit in recess 22 in the top of the basin. Ground water flows through the grate and into catch basin chamber 20.

Catch basin filter 26 includes a filter bag 28 in basin chamber 20 and four flaps 30 joining the top of the bag. The flaps extend along the sides of the top of the basin 12 and are sandwiched in recess 22 between the basin and the grate. Flap ends 32 are located outside the sides of the grate. Loops 34 are sewn into the ends of the flaps and extend along the sides of the basin outside the grate. Openings 36 are cut in the ends of the flaps through the loops. As shown in FIG. 1, two openings 36 are provided in each long flap and one opening is provided in each short flap. Lift rods 40 are inserted in the loops 34 and are exposed at openings 36. When it is necessary to lift the bag from the basin, a lift rod is inserted in each flap loop between the open ends of the flap. Lift chains are hooked to the exposed rods at the openings to lift the full filter from the basin.

Filter bag 28 includes four tapered sidewalls 38 each located adjacent one wall of basin 12. The sidewalls are sewn together to form the closed filter bag. Flaps 30 are extensions of the bag sidewalls.

Filter 26 is preferably made from a woven plastic fabric. Narrow strips of a plastic, such as polypropylene, are tightly woven together to form a porous fabric. The fabric permits liquids to flow freely through the filter bag but captures solids. A filter made from plastic fabric, commonly referred to as geotextile, can support a load of solids having a total weight of up to 4,000 pounds.

Figure 2:
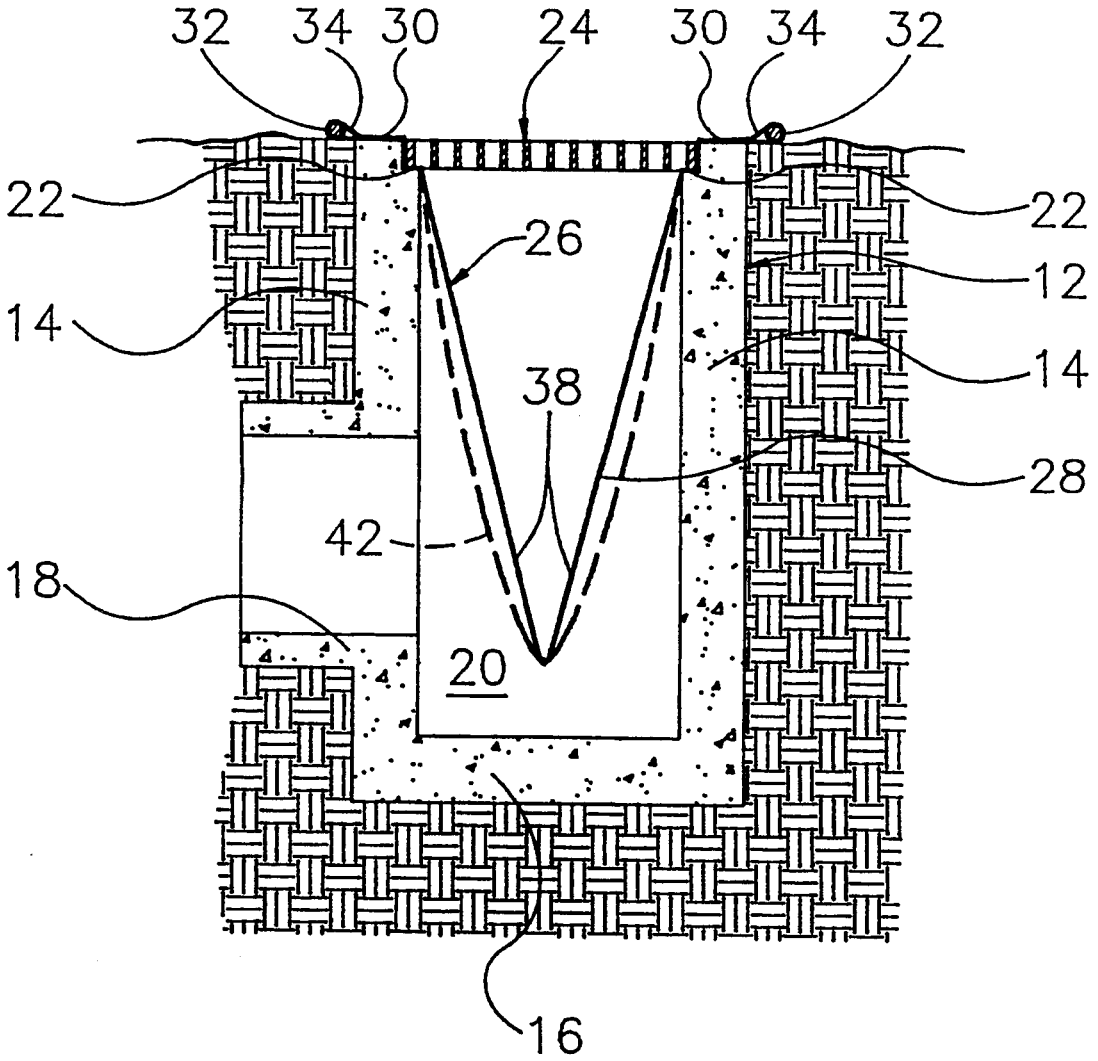
FIG. 2 is a sectional view taken along line 2—2 of FIG. 1.

Bag 28 of filter 26 is located in chamber 20 with flaps 30 extending at grade level away from the catch basin. The tapered bag sidewalls 38 are located away from the walls of chamber 20 and outlet 18 as the bag hangs in the catch basin. As shown in FIG. 1, the upper or top portion of each bag sidewall extends along each basin sidewall. The width of the bag sidewalls decreases below the grate so that the bag hangs free of the sidewalls of the catch basin and does not obstruct filtration even when filled with solids and outwardly bowed as shown by dashed line 42. Grate 24 is fitted in the recess sandwiching the flaps between the grate and the basin. See FIG. 2. The weight of the grate maintains the bag in the chamber.

Ground water and solids flow through the grate and into the filter bag 28 in the catch basin 12. The ground water flows through the bag sidewalls and out of the catch basin through outlet pipe 18. Solids are filtered from the ground water and captured in the bag. Over time, solids accumulate in the bag. The weight of the accumulated solids causes the bag to expand. As the bag expands and becomes full, the walls of the bag do not come in contact with the sidewalls of the catch basin chamber. Thus, the expanded bag does not block the flow of water through the catch basin chamber or into the pipe 18 and can be easily removed from the chamber.

When the bag is full, lift rods 40 are inserted in the flaps 36. The grate 24 is removed, hooks are secured to the length of rod exposed in arcuate openings 36 and the bag is lifted from the catch basin. The bag is dumped and replaced in the catch basin. The grate is refitted in recess 22 to hold the empty filter in place and the rods are removed from the flaps.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. The combination comprising:

a) a catch basin including, i) an inlet through which water and solids flow into the catch basin, ii) an outlet through which water flows out of the catch basin, and iii) basin sidewalls;

b) a catch basin filter including, i) a filter bag in the catch basin for capturing the solids which enter the catch basin through the inlet, said bag having an open top at the catch basin inlet, a closed bottom and bag sidewalls, and ii) a plurality of elongate lift flaps joining the top of the bag and extending across the sidewalls at the catch basin inlet, loops in the flaps away from the bag and spaced openings in the loops; and c) a grate on the catch basin overlying the catch basin inlet, portions of the flaps between the filter bag and the loops extending between the grate and the catch basin inlet so that the grate sandwiches the flaps in place against the catch basin and the flaps support the bag in the catch basin.

2. The combination of claim 1 including a plurality of lift rods of sufficient length to be extended into the loops in the flaps so that portions of the rods are exposed at the openings for attachment to lift members.

3. The combination of claim 1 wherein the catch basin is rectangular and the filter bag includes two pairs of opposed flaps.

4. The combination of claim 3 wherein the bag and flaps are formed from plastic fabric.

5. The combination as in claim 3 wherein the bag has a pair of narrow sidewalls and a pair of wide sidewalls and a pair of narrow flaps and a pair of wide flaps.

6. The combination as in claim 5 including a single opening in each narrow flap and a pair of openings in each wide flap.

7. The combination as in claim 6 including a recess at the top of the catch basin, said recess supporting the grate.

8. The combination as in claim 3 including a recess in the top of the catch basin, said grate being seated in the recess and securing the flaps against the recess.

9. The combination of claim 1 wherein the filter bag is formed of a woven material.

10. The combination of claim 9 wherein the woven material is plastic.

11. The combination comprising:

a) a catch basin including, i) an inlet through which water and solids flow into the catch basin, ii) an outlet through which water flows out of the catch basin, and iii) a plurality of basin sidewalls, each sidewall having an upper end at the basin inlet and a recess located at said upper end, said sidewalls defining a chamber;

b) a filter including, i) a filter bag in the chamber for capturing solids which enter the catch basin through the basin inlet, said bag having an open top, a closed bottom and bag sidewalls extending between the top and bottom of the bag, and ii) a flap joining the top of each bag sidewall and located in the recess of a basin sidewall and extending away from the recess, and a filter bag removal member on each flap outside of the catch basin engagable with a lift member to facilitate removal of the filter bag from the catch basin; and c) a grate located on the top of the basin inlet having grate sides, said grate sides being seated in the recesses to sandwich the flaps against the top of the basin and hold the bag in the chamber.

12. The combination as in claim 11 including:

a) a loop extending along each flap with an opening in the flap loop; and b) an elongate rigid member fitted in the flap loop with a portion of the member accessible through the opening.

13. The combination as in claim 11 wherein the bag has a pair of narrow sidewalls, a pair of wide sidewalls, and a single loop extending across the end of each flap.

14. The combination of claim 11 wherein the filter bag is formed of a woven material.

15. The combination of claim 14 wherein the woven material is plastic.

* * * * *